United States Patent [19]

Kutterer

[11] Patent Number: 4,723,687

[45] Date of Patent: Feb. 9, 1988

[54] TUBE WITH SCREW CAP

[76] Inventor: Franz Kutterer, Rudolf-Freytag-Str. 7, Karlsruhe 21, Fed. Rep. of Germany, 7500

[21] Appl. No.: 472,764

[22] Filed: Mar. 7, 1983

Related U.S. Application Data

[63] Continuation-in-part of Ser. No. 243,883, Mar. 16, 1981, abandoned.

[51] Int. Cl.[4] ..... B67B 7/54

[52] U.S. Cl. ..... 222/83; 222/91; 222/541

[58] Field of Search ..... 222/81, 83, 83.5, 91, 222/541; 220/277, 278

[56] References Cited

U.S. PATENT DOCUMENTS

| | | | |
|---|---|---|---|
| 3,240,226 | 3/1966 | Burkholder | 222/83 X |
| 4,185,756 | 1/1980 | Sciamonte | 222/83.5 |

FOREIGN PATENT DOCUMENTS

| | | | |
|---|---|---|---|
| 665772 | 9/1929 | France | 222/81 |
| 1048219 | 1/1956 | France | 220/278 |
| 1117703 | 5/1956 | France | 222/83 |
| 1246832 | 10/1960 | France | 220/278 |
| 1416483 | 9/1965 | France | 222/83 |
| 521895 | 3/1955 | Italy | 220/278 |
| 689814 | 4/1965 | Italy | 220/278 |
| 1189439 | 4/1970 | United Kingdom | 222/83 |
| 1379962 | 1/1975 | United Kingdom | 222/83 |

*Primary Examiner*—Charles A. Marmor

[57] ABSTRACT

A tube consisting of plastic or metal has a threaded tube neck which is sealed by a membrane and includes a cap with internal thread for mounting on the tube neck. The cap has projecting from its face a tubular punch member whose outer diameter correponds to the inner diameter of the tube neck and which has a circular cutting edge formed thereon for cutting the membrane from the tube neck when the cap is screwed or pressed onto the tubular neck. A retaining member is provided for holding the membrane in engagement with the punch member to prevent it from entering the tube.

9 Claims, 6 Drawing Figures

TUBE WITH SCREW CAP

The present application is a continuation-in-part application of application Ser. No. 243,883, filed Mar. 16, 1981, now abandoned.

BACKGROUND OF THE INVENTION

1. Field of the Invention

The invention relates to a tube consisting of plastic or metal and having a neck sealed by a membrane and covered by a cap having a punch member for piercing the membrane.

2. Description of the Prior Art

The neck openings of tubes, particularly tubes containing medication, are usually sealed by membranes in order to prevent contamination of the content of such tubes. In this manner, the tube content can be stored over a relatively long period of time even if the content is easily perishable once exposed to air. Also medication can remain sterile until the tube is opened.

The tube is normally opened by means of a punch which is disposed in the screw cap and with which the membrane is pierced and pushed into the interior of the tube. Usually, the punch is provided inside on top of the cap and the cap is firmly threaded onto the tube neck in order to prevent the sensitive membrane from being damaged by mechanical objects. It is, however, also possible to arrange the punch member within the screw cap, but then means must be provided for preventing unwanted piercing of the membrane upon mounting of the screw cap onto the tube neck.

With all these arrangements, the membrane, when pierced, is pushed into the tube. This however is disadvantageous since parts of the ruptured membrane will emerge from the tube with the content or, at least, they will return to their original position, thereby restricting or impeding the flow of the content from the tube and resulting in inconveniences. It is therefore the principal object of the present invention to provide a tube whose neck is closed by a membrane in the manner known as reliable but which can be opened without the membrane being forced into the tube.

SUMMARY OF THE INVENTION

A tube consisting of plastic or metal has a neck closed by a membrane sealing the tube. A cap to be mounted on the tube neck has a tubular punch member with a circular cutting edge of a diameter corresponding to the inner diameter of the neck so as to cleanly sever the membrane from the neck when the cap is mounted for this purpose. Means are provided for holding the severed membrane in engagement with the cap to prevent the membrane from entering the tube when severed from the tube neck.

The membrane may consist of plastic or metal depending on the tube material. The membrane is engaged by the cap before it is cut by the tubular punch member from the neck and is forced by the tube content into the tubular punch member away from the neck walls whereby the membrane is compressed and forced into the tubular punch member in a bulged shape. The tension produced in this position causes engagement of the membrane with the inner wall surface of the punch member such that the membrane plate is retained therein. Since furthermore the outer diameter of the tubular punch member is the same as the inner diameter of the tube neck and the tubular punch member has an inwardly slanted cutting edge forming a cutting edge at the outer circumference of the punch member, the punch member is forced into sliding engagement with the walls of the tube neck and the membrane is so cleanly separated that there remains no restriction in the tube neck which might impede the outflow of the material contained in the tube and that no membrane pieces remain which may be carried out with the material in the tube.

Consequently, in compliance with the object of the present invention, the membrane, after being severed, is not simply pushed into the tube but is held in engagement with the punch member. At the same time, the neck opening is clear and smooth providing for a clean outflow of material over the full cross-sectional area of the tube neck with no restrictions behind which portions of the tube content might collect and solidify.

In order to facilitate the cutting of the membrane, the cutting edge of the punch member may be in the form of a screw thread such that cutting of the membrane occurs slowly while the cap is screwed on.

In order to safely retain the severed membrane within the cap, the inner surface of the punch member may alternatively be threaded, it may be roughened or it may be provided with ridges. If the membrane is relatively thick, it is considered desirable to provide a central retaining pin within the punch member which provides for firm engagement of the membrane with the punch member walls and for safe retaining of the severed membrane. Such a retaining pin projects beyond the cutting edge of the punch member. It is preferably roughened or provided with ridges or has an annular bead spaced from its piercing point or if it is provided with an annular groove preferably in radial alignment with an annular bead in the tubular punch member so that the severed membrane will be securely wedged onto the retaining pin and will not enter the tube.

Preferably, the retaining pin is threaded and preferably with a thread of greater pitch than that of the cap. With this arrangement, the retaining pin screws itself into the membrane which, when subsequently cut by the tubular punch member, will safely be engaged by the retaining pin.

It is also possible to equip the membrane with an axially outward projecting collar whose outside diameter corresponds to the inside diameter of the tubular punch member. With this arrangement the tubular punch member first receives the collar when the tube is opened for the first time before the membrane is cut so that the collar with the membrane thereon is securely held within the tubular punch member of the cap, thereby forming a plug. Preferably, the collar is hollow and so formed that it resiliently engages the tubular punch member wall. Again, the collar may be roughened, provided with ridges or with an annular recess or an annular bead, or the collar may have external thread and the punch member may have a cooperating internal thread which would have the same pitch as the cap thread. An annular bead or recess may also be formed on the inner surface of the tubular punch member which receives the collar, the bead of the punch member or the collar being received in the annular recess of the collar or the punch member for engaging the collar within the tubular punch member.

It is particularly pointed out as being especially advantageous that the tubular punch member does not only cut the membrane cleanly and engages it securely but forms a plug which keeps the tube opening clean and free from obstructions. Furthermore, insertion of the tubular punch member into the tube neck provides for an extraordinarily good seal in addition to the seal obtained by engagement of the front edge of the tube neck by the cap provided that the punch member is arranged in the threaded cap opening.

This, however, requires an accurate fit between the tubular punch member and the tube neck opening and consequently insertion of the punch member into the neck member might be difficult. It is therefore advantageous if the tube neck opening is slightly funnel-shaped.

To facilitate cutting of the membrane, an annular groove may be formed therein adjacent the tube neck.

BRIEF DESCRIPTION OF THE DRAWINGS

FIG. 6 shows the embodiment of FIG. 5 with the cap screwed on.

DESCRIPTION OF THE PREFERRED EMBODIMENTS

Figure 1:
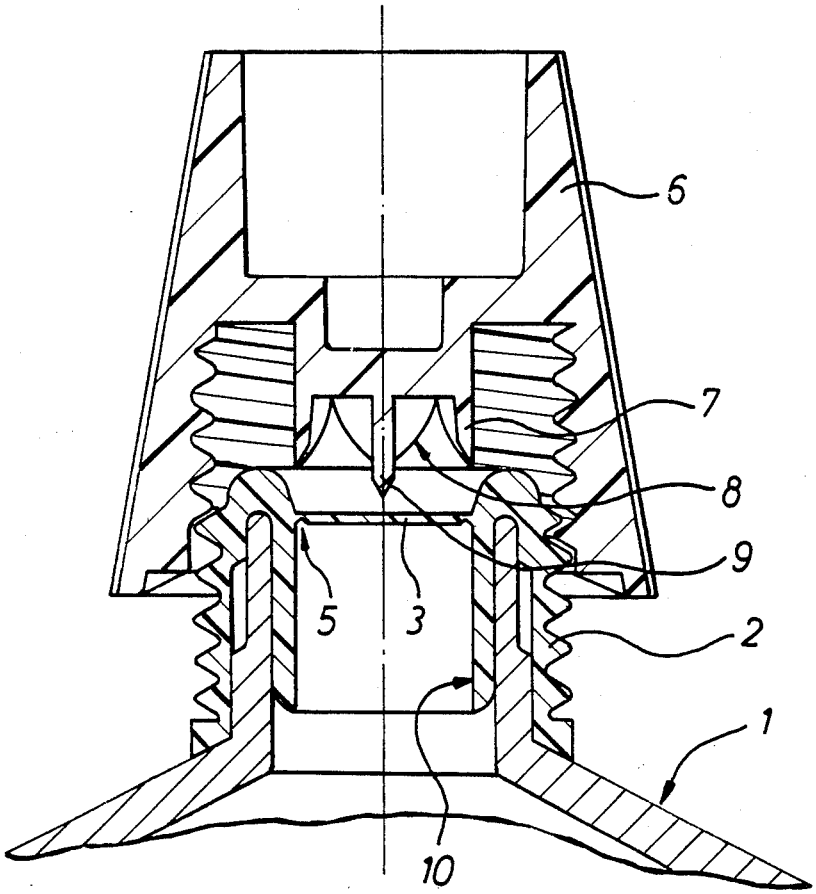
FIG. 1 shows an embodiment of the invention in cross-section with a cap on top of a tube neck.

As shown in the various figures, a tube 1 consisting of plastic has a neck 10 threaded at 2 onto which neck 10 a cap 6 may be screwed. The tube 1 is sealed at its neck 10 by a membrane 3 which, at its outer circumference, has a groove 5.

Figure 2:
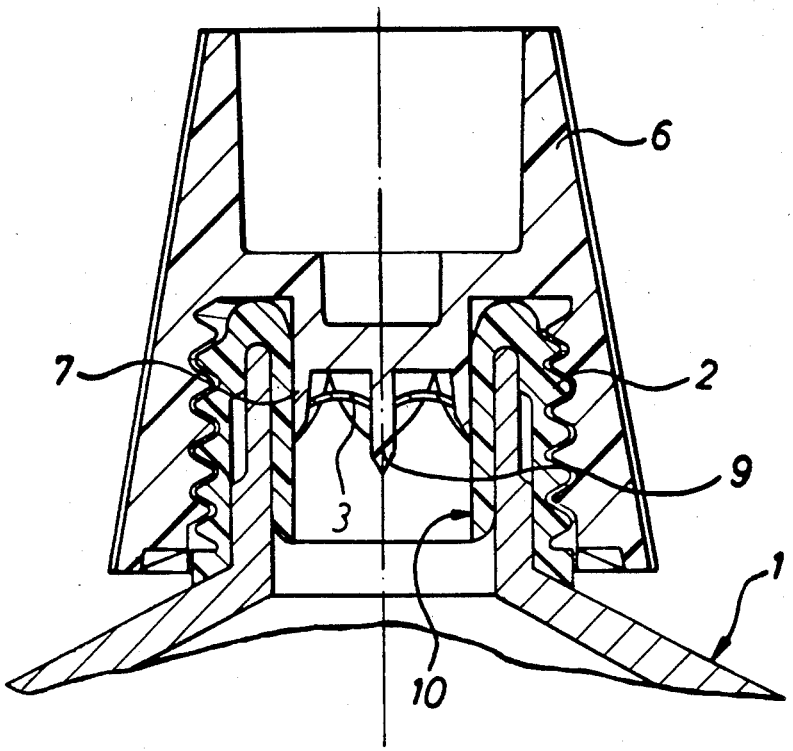
FIG. 2 is a like view with the cap screwed onto the tube neck.

Within the cap 6 there is disposed a circular tubular punch member 7 which has tooth-like cutting edges 8 and centrally within the tubular punch member 7 there is a retaining pin 9 of essentially constant diameter whose pointed tip is disposed beyond the cutting edges 8. FIG. 1 shows the cap 6 disposed on top of the tube neck 10 whereas FIG. 2 shows the cap 6 screwed onto the tube neck 10. While the cap is screwed on the tube neck 10, the retaining pin 9 first pierces the membrane 3 whereby the membrane 3 resiliently engages the retaining pin 9. While the cap is further screwed down the cutting edges 8 sever the membrane 3 from the tube neck 10 such that it is forced into a warped shape in a position about as shown in FIG. 2.

Figure 3:
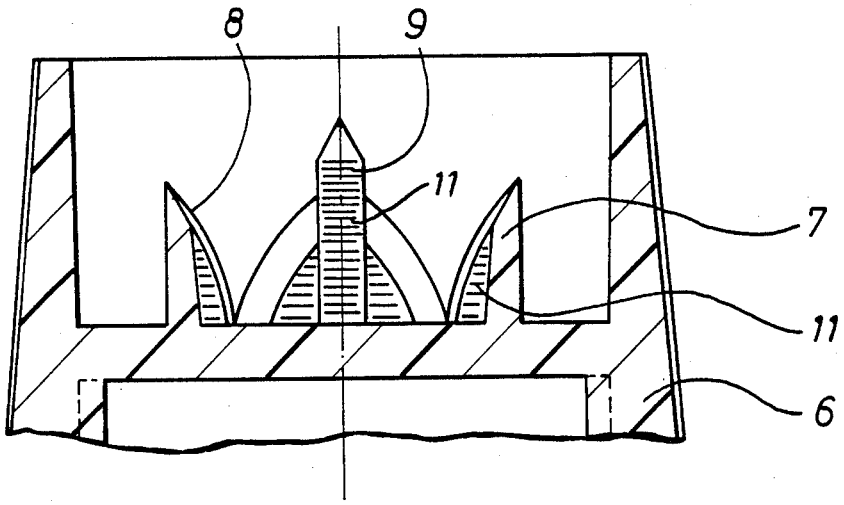
FIG. 3 shows an embodiment in which punch members and retaining pins are arranged in the cap opening opposite its threaded end.

In FIGS. 1 and 2 the punch member is shown arranged in the threaded cap and FIG. 3, in contrast, shows the punch member 7 and retaining pin 9 arranged in the head portion of the cap 6. In this case, the punch member is simply pushed onto the tube neck as it is used only for removing the membrane from the tube neck. It is also shown how the retaining pin 9 as well as the punch member 7 have roughened surfaces, that is, they are provided with ridges 11 so as to be able to firmly engage the membrane 3 when it is severed from the tube neck 10.

Figure 4:
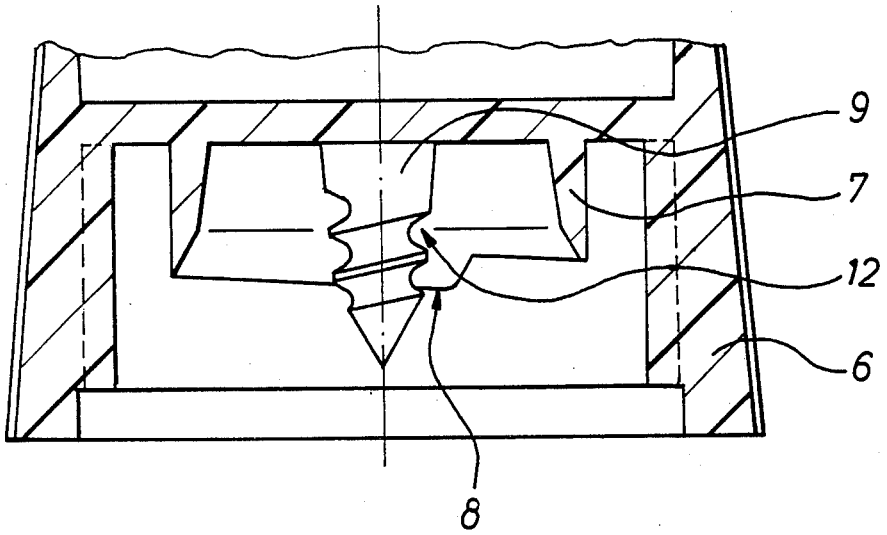
FIG. 4 shows an embodiment with a central threaded retaining pin.

FIG. 4 shows an arrangement in which the retaining pin 9 is provided with a thread 12. When such a cap with such threaded retaining pin is screwed onto the tube neck, the pointed tip of the retaining pin 9 will first pierce the membrane 3 and will then screw itself into the membrane 3. Then only will the cutting edge 8 of the punch member 7 reach the membrane 3 and cut the membrane 3 from the tube neck 10 along the groove 5. The membrane 3 is by then firmly held by the thread 12 of the retaining pin 9 and, in addition, is compressed within and engaged by the walls of the tubular punch member 7.

Figure 5:
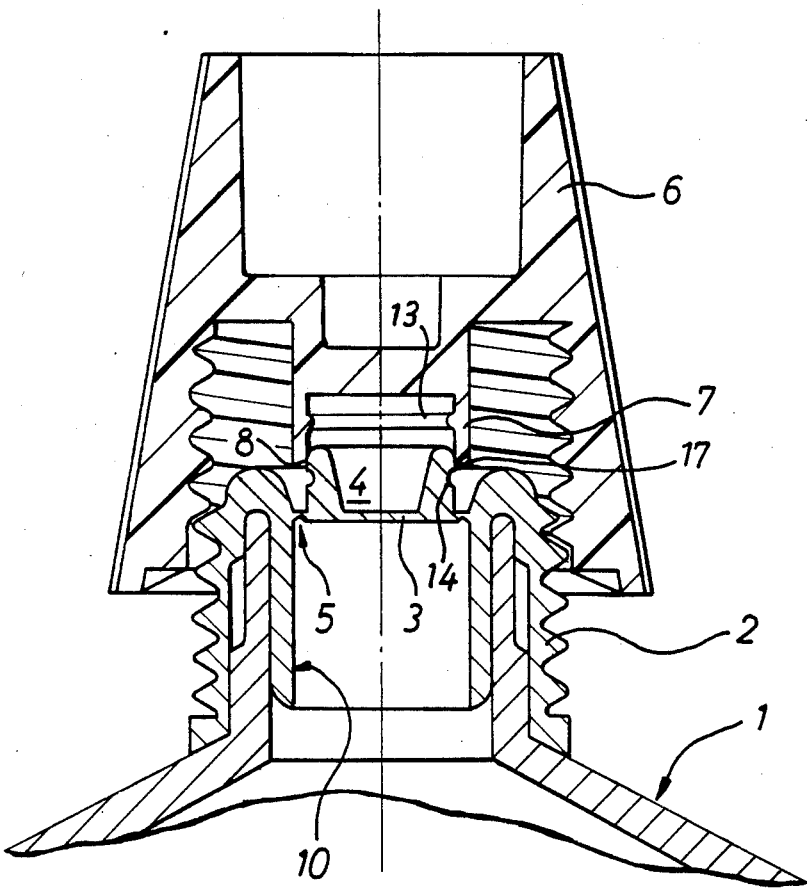
FIG. 5 is a view similar to FIG. 1 of an embodiment in which, however, the membrane is provided with a plug.
Figure 6:
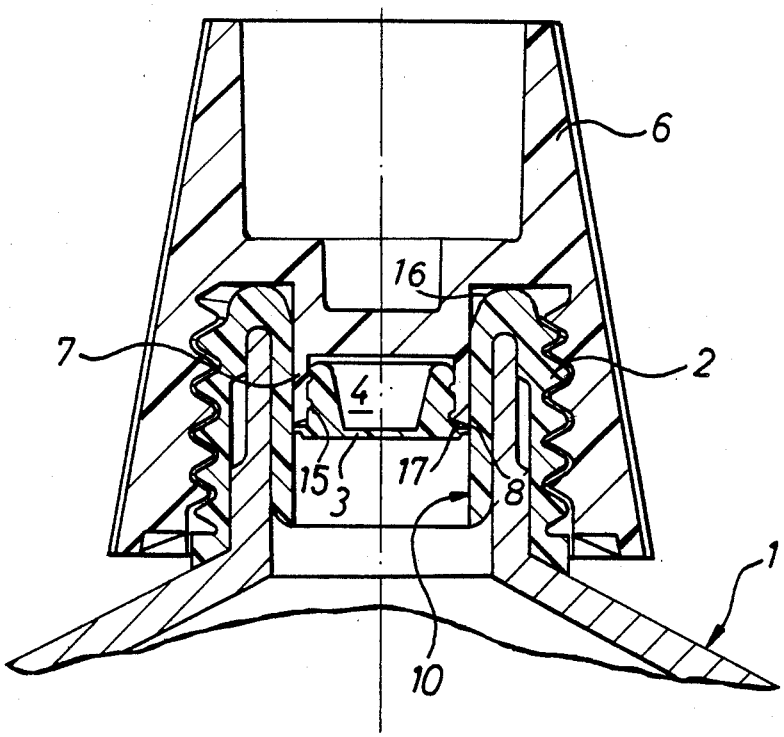

FIGS. 5 and 6 show an embodiment in which the membrane 3 is provided with a collar 4 adapted to be received within the tubular punch member 7 when the cap 6 is screwed onto the tube neck 10 and before the tubular punch member 7 severs the membrane 3 from the tube neck 10. This final state, in which the membrane is severed, is shown in FIG. 6 from which it can also be seen that the collar 4 and, together therewith, the membrane 3 are firmly engaged by the tubular punch member 7 within the cap 6. For better engagement with collar 4, the punch member 7 may be provided with an annular bead 13 as shown in FIG. 5 and the collar 4 may have an annular recess 14 formed therein so that the annular bead 13 is received in the annular recess 14 when the membrane 3 is cut with the collar 4 engaged within the tubular punch member 7. The collar 4 with the membrane 3 then remains within the tubular punch member 7 forming a flat plug for cleanly closing the tube opening.

As shown in FIG. 6 the tubular punch member 7 and the collar 4 may have threads 15 corresponding in pitch to the thread of the screw cap 6 so that the collar 4 is threadedly engaged within the tubular punch member 7 when the membrane 3 is cut from the tube neck.

Preferably, the tube neck 10 is provided with a rounded or slightly conical portion 16 at its open end so that the tubular punch member is easily guided into the tube neck especially since the cutting edge 8 of the tubular punch member 7 is formed at the outer circumference of the punch member 7.

The cutting edge 8 is formed by the inwardly slanted face 17 of the punch member 7 which, when cutting the membrane 3, forces the walls of the punch member 7 outwardly into close contact with the inner surface of the tube neck 10 which guides and, at the same time, provides back-up support for the tubular punch member providing for a clean cut of the membrane along the inner surface of the tube neck.

With this arrangement the cap is only lightly screwed onto the tube neck when the tube is filled and shipped. The user will then first screw the cap tightly onto the neck of the tube whereby the collar is received and engaged within the tubular punch member which then cuts the membrane off the tube neck and forms, together with the collar and the membrane, a plug cleanly closing the tube opening when the cap is screwed onto the tube neck.

What I claim is:

1. A tube having a threaded neck with a cylindrical opening of a predetermined diameter; a membrane integrally formed with, and extending across, said neck for sealing the tube; a cap having an internal thread so as to be threaded onto said neck; said cap having an integral tubular punch member axially projecting therefrom for cutting said membrane; said punch member having an outer diameter about equal the inner diameter of said neck opening and having an inwardly slanted front end forming a cutting edge at the outer surface of said punch member adjacent the inner surface of said neck such that, upon cutting of said membrane, said tubular punch member is forced outwardly into close contact with said neck so as to be guided thereby for cleaning cutting said membrane from the inner opening defining surface of said neck; and a retaining pin of essentially constant diameter along its length which is disposed concentrically within said tubular punch member, said retaining pin extending axially beyond said tubular punch member and having a pointed tip arranged fully in front of said tubular punch member for piercing said membrane before it is cut from said neck by said punch member said retaining pin also being provided with a rough membrane engaging surface for engaging said membrane to retain it within said cap after the membrane is cut from said neck.

2. A tube as claimed in claim 1, wherein said cutting edge has tooth-like projections.

3. A tube as claimed in claim 1, wherein the inner surface of said tubular punch member is roughened so as to firmly engage said membrane.

4. A tube having a threaded neck with an opening of a predetermined diameter, a flat membrane integrally formed with, and extending straight across, said neck for sealing the tube, and a cap having an integral thread so as to be threaded onto said neck, said cap having a tubular punch member axially projecting therefrom for cutting said membrane, said punch member having an outer diameter corresponding to the diameter of said neck opening and having an inwardly slanted front end forming a cutting edge at the outer surface of said punch member adjacent the inner surface of said neck such that, upon cutting of said membrane, said tubular punch member is forced outwardly into close contact with said neck so as to be guided thereby for cleanly cutting said membrane from the inner surface of said neck, said membrane being provided with an integral open ended tubular collar having an outer diameter corresponding to the inner diameter of the tubular punch member and axially projecting from said membrane so as to be snugly received and engaged in said tubular punch member one of said tubular punch members and said collar having an annular recess formed in its side wall and the other having an annular bead adapted to be received in said annular recess for retaining said membrane and forming with the membrane and the collar a plug tightly closing the neck opening of said tube when said cap is screwed onto said neck.

5. A tube as claimed in claim 4, wherein said collar has said annular recess formed in its outer wall spaced from said membrane.

6. A tube as claimed in claim 4, wherein said tubular punch member has said annular bead formed at its inner wall spaced from said cutting edge.

7. A tube as claimed in claim 4, wherein said tubular punch member has an internal thread and said collar has an external thread so as to be threadedly engaged by said tubular punch member.

8. A tube having a threaded neck with a cylindrical opening of a predetermined diameter; a membrane integrally formed with, and extending across, said neck for sealing the tube; a cap having an internal thread so as to be threaded onto said neck; said cap having an integral tubular punch member axially projecting therefrom for cutting said membrane; said punch member having an outer diameter about equal the inner diameter of said neck opening and having an inwardly slanted front end forming a cutting edge at the outer surface of said punch member adjacent the inner surface of said neck such that, upon cutting of said membrane, said tubular punch member is forced outwardly into close contact with said neck so as to be guided thereby for cleanly cutting said membrane from the inner opening defining surface of said neck; and a retaining pin of essentially constant diameter along its length which is disposed concentrically within said tubular punch member, said retaining pin extending axially beyond said tubular punch member and having a pointed tip arranged fully in front of said tubular punch member for piercing said membrane before it is cut from said neck by said punch member, said retaining pin also being threaded for engaging said membrane to retain it within said cap after the membrane is cut from said neck.

9. A tube as claimed in claim 8 wherein said cutting edge is arranged in the form of a screw thread.

* * * * *